US009260287B2

(12) United States Patent
Dominguez

(10) Patent No.: US 9,260,287 B2
(45) Date of Patent: Feb. 16, 2016

(54) RIDING CROP

(76) Inventor: Ramon Dominguez, Floral Park, NY (US)

( * ) Notice: Subject to any disclaimer, the term of this patent is extended or adjusted under 35 U.S.C. 154(b) by 731 days.

(21) Appl. No.: 13/588,834

(22) Filed: Aug. 17, 2012

(65) Prior Publication Data

US 2013/0043300 A1 Feb. 21, 2013

Related U.S. Application Data

(60) Provisional application No. 61/524,579, filed on Aug. 17, 2011.

(51) Int. Cl.
*B68B 11/00* (2006.01)
*F41B 15/02* (2006.01)

(52) U.S. Cl.
CPC ..... *B68B 11/00* (2013.01)

(58) Field of Classification Search
CPC ..... B68B 11/00; F41B 15/02
USPC ..... 231/2.1, 4, 5; 463/47.2
See application file for complete search history.

(56) References Cited

U.S. PATENT DOCUMENTS 2,772,514 A * 12/1956 Mangnall ..... 47/1.43
5,295,926 A * 3/1994 Tanabe ..... 482/12
5,598,596 A * 2/1997 Jones et al. ..... 15/1.52
6,036,602 A * 3/2000 Abbott ..... 463/47.2
7,828,200 B2 * 11/2010 Parow ..... B68B 11/00 231/2.1

FOREIGN PATENT DOCUMENTS

GB 2 281 186 B 1/1995

* cited by examiner

*Primary Examiner* — Rob Swiatek
(74) *Attorney, Agent, or Firm* — Leydig, Voit & Mayer, Ltd.

(57) ABSTRACT

A riding crop for controlling a horse by striking its flank or hindquarters includes a slender, elongated shaft with a handle at its proximal end and a popper at its distal end. To ensure that the popper is normally the first part of the riding crop that strikes the horse, the popper has a thicker or larger cross-sectional dimension than the mid-length portion of the shaft that supports the popper. The popper can have a relatively resilient or pliable characteristic with respect to the more rigid shaft. When the pliable popper contacts the horse prior to any other portion of the riding crop, it deforms to soften or cushion the impact from the riding crop reducing the chance of injury or harm to the horse.

9 Claims, 2 Drawing Sheets

100
102
104
106
108
110
112
120
130
132
150
152
160
ϕ124
ϕ126
2
3

RIDING CROP

CROSS-REFERENCE TO RELATED APPLICATIONS

This patent application claims the benefit of U.S. Provisional Patent Application No. 61/524,579, filed Aug. 17, 2011, which is incorporated by reference.

BACKGROUND OF THE INVENTION

Riding crops are a type of whip that are typically used by horse riders, trainers and others to control and encourage a horse to act, run or gallop in a certain manner such as during a horse race or other equestrian event. A riding crop typically has an elongated, slender shaft that can be held at one end by the rider and terminates with a popper disposed at the other end that is intended to make contact with the horse. A rider straddling a horse's back can accelerate the riding crop by flicking their wrist so that the popper contacts the horse's rump, side or hindquarters. As will be appreciated by those of skill in the art, the horse typically responds to contact with the riding crop by changing or maintaining direction or speed in a manner intended by the rider.

If striking the horse with the riding crop is done incorrectly or excessively, that action may be considered abusive or cruel and may harm the horse. Therefore, the popper is typically designed to reduce or minimize the amount of pain and injury inflicted upon the horse. For example, a common type of popper is made from a rectangular strap or loop of leather or similar material that is folded over on itself and extends axially from the distal end of the shaft of the riding crop. The folded-over strap provides a relatively wide, flat and highly flexible surface that actually makes contact and thereby distributes the striking force over a larger area and allows the popper to bend or flex against the horse upon impact so as to reduce the perceived impact felt by the horse and hopefully reduce trauma and the chance of breaking skin. However, the riding crop may unintentionally rotate or twist in the rider's hand so that the popper does not contact the horse squarely along the flat surface but rather along an edge of the folded-over strap. Additionally, even when used correctly, a flexible leather strap may still harm or injure the horse. Accordingly, there is a desire for an improved and more humane riding crop.

BRIEF SUMMARY

The disclosure provides a riding crop for controlling a horse. The riding crop includes an elongated shaft with a handle for griping by the rider at the proximal end and a popper for making contact with the horse at the distal end. To ensure that the popper contacts the horse prior to any other part of the riding crop, the popper has an oblong, bulbous shape and is thicker with respect to and protrudes outwardly around the circumference of a mid-length portion of the shaft that supports the popper. Furthermore, to cushion or soften the striking force, the popper can have a pliable or resilient characteristic allowing it to deform upon contact with the horse.

An advantage of the described riding crop is that it reduces the pain inflected and the likelihood of injury or harm to the horse during use. Another possible advantage is that, in some embodiments, the durability of the riding crop may be improved by a water impermeable construction. These and other advantages and features of the present disclosure will become apparent from the following detailed description and the accompanying drawings.

DETAILED DESCRIPTION

Figures 1, 2, 3:
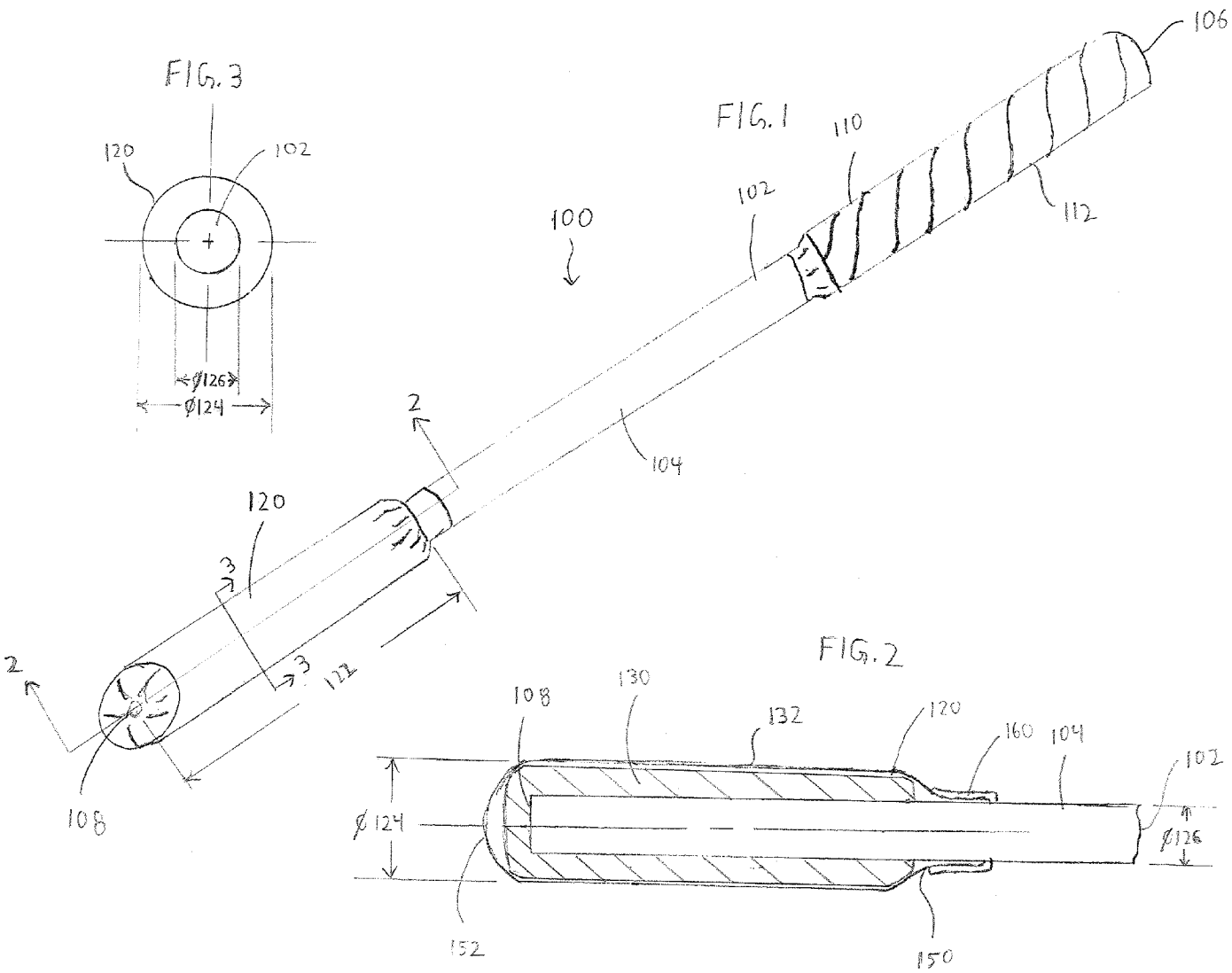
FIG. 1 is a perspective view of a riding crop for controlling a horse having an elongated shaft with a handle at its proximal end and an improved popper at its distal end.
FIG. 2 is a cross-sectional view taken over the length of the popper along line 2-2 of FIG. 1 and illustrating the multi-layered construction and relative dimensions of the popper and shaft.
FIG. 3 is a cross-sectional view of the popper taken along line 3-3 of FIG. 1 also illustrating the relative dimensions of the popper and shaft.

Now referring to FIG. 1, wherein like reference numbers refer to like elements, there is illustrated a riding crop 100 of the type used by riders to control a horse by striking its flank or hindquarters. The riding crop 100 includes an elongated, slender and generally straight shaft 102 that extends between a first or proximal end 106 toward an opposing second or distal end 108. The long mid-length portion 104 extends between the proximal end 106 and the distal end 108. The riding crop 100 can have any suitable length from the proximal end 106 to the distal end 108 such as, for example, about thirty (30) inches. Of course, the overall length of the riding crop will depend on the size of the horse, style of riding and other factors and should not be construed as a limitation on the invention.

The rod-like shaft 102 may be generally circular in cross-section and may be made from any suitable material such as fiberglass, carbon fiber, graphite composite or another similar material. However, in other embodiments, the shaft 102 may have other cross-sections such as that of a polygon. Preferably, the shaft 102 should demonstrate some degree of flexibility or plasticity to help absorb the shock of impact of the riding crop 100 against the horse without breaking or snapping. To hold the riding crop 100, there is formed at the proximal end 106 of the shaft 102 a handle 110. The handle 110 may be thicker or larger in diameter than the mid-length portion 104 of the shaft 102 for ease of handling. For improved gripping by the rider, the handle 110 may include a rubber coating 112 that may be spirally striated along its length. In other embodiments, a length of tape may be helically wrapped around the shaft 102 proximate to the proximal end 106 much like as is done with a tennis racket. The handle 110 may extend about twelve (12) inches or so along the shaft length from the far proximal end 106 so that riders can adjust their grip of the shaft at various locations.

For contacting the horse, there is disposed at the distal end 108 of the shaft 102 opposite the handle 110 an oblong, bulbous popper 120 which preferably is circular in cross-section. The popper 120 may have a length 122 such that the popper generally extends along the last seven (7) or eight (8) inches of the riding crop 100 from the distal end 108 of the shaft 102 toward the handle 110. To ensure that the popper 120 strikes the horse before the shaft 102, the bulbous popper may be thicker or larger than the mid-length portion 104 of the shaft. Hence, the popper 120 protrudes outwardly from and 360° about the exterior circumference of the shaft 102 so that the popper contacts the horse first. Additionally, because the preferred popper 102 is round or circular in cross-section, it will present a smooth, radial curve that contacts the horse eliminating the chances of striking the horse along an edge of a prior art popper if the riding crop rotates within the rider's hand.

For example, referring to FIGS. 2 and 3, the thicker popper 120 may have a first diameter 124 of about seven-eights (⅞) of an inch to one (1) inch while the thinner mid-length portion 104 of the shaft 102 has a second diameter 126 of about three-eights (⅜) to one-half (½) of an inch. Hence, the popper 120 has a diameter 124 slightly greater than twice the diameter 124 of the mid-length portion. However, in other embodiments, the relative diameters between the popper and the mid-length portion 104 of the shaft may vary. Additionally, in embodiments in which the shaft and the popper are not necessarily circular in cross-section, it will be appreciated that the popper can have a cross-sectional dimension corresponding to its thickness that is greater than a respective cross-sectional dimension of the mid-length portion of the shaft.

To further reduce the likelihood of harming or injuring the horse, the popper 120 is designed to have a pliable, malleable or cushioning quality or characteristic, especially relative to the more rigid shaft 102. When the pliable popper 120 contacts the horse, it can deform and thereby absorb or dissipate the striking force. For example, in a preferred construction illustrated in FIG. 2, the popper 120 can include a resilient padded member 130 that is disposed around the distal end 108 of the shaft 102 and an outer sleeve 132 that secures the resilient padded member thereto. Further, the resilient padded member 130 can be generally coextensive in length 122 with the oblong popper 120 so that the portion of the shaft 102 proximate to the distal end 108 is adequately padded and will not directly contact the horse. The resilient padded member 130 thereby softens and dampens the blow when the popper 120 contacts the horse. The outer sleeve 132 can completely surround the resilient padded member 130. In other embodiments, the bulbous popper can be formed as a single structure such as by molding, dipping or otherwise attaching a softer, elastic material around the distal end of the relatively stiffer shaft. In some embodiments of the single piece popper, the popper may be co-molded to advantageously layer different materials having different elastic properties over the distal end of the shaft.

To provide the desired resilient quality, the resilient padded member 130 can be made from any suitable material such as, for example, foamed natural or synthetic rubber or a similar pillowly or cushiony material. If a foamed material is selected, it may be opened-celled or closed-celled material. Examples of such materials include closed-cell polyethylene foam, foamed latex rubber, and other elastomers. As can be appreciated, the cellular or cushiony structure of these materials allows them to partially collapse upon impact with a surface thereby absorbing the impact force and later resiliently recover their original shape. Another possible advantage of using foamed or cushiony materials is that they are airy and lightweight thereby reducing the weight of the riding crop and thus the momentum of the striking force applied to the horse.

Consistent with the flexible and resilient quality of the popper 120, the outer sleeve 132 can similarly be made from an elastic material such as a synthetic rubber, thin-walled sheet that can stretch, conform to and displace with the resilient padded member 130 upon impact with a surface. Another possible advantage of using a synthetic rubber sheet for the outer sleeve 132 is that such materials are often impermeable to water or other fluids. Hence, water from washing the popper 120 or rainfall or sweat from contact with the horse will not penetrate to the foamed or cushiony material of the resilient padded member 130 that could otherwise cause the popper to deteriorate or become weighed down and thereby increase the striking force against the horse. In those embodiments in which the popper is made as a single piece of elastic material molded or attached to the shaft, the exterior surface of the popper can be formed with a smooth, solid, close-celled structure to prevent migration of fluid into the interior of the popper.

Figure 4:
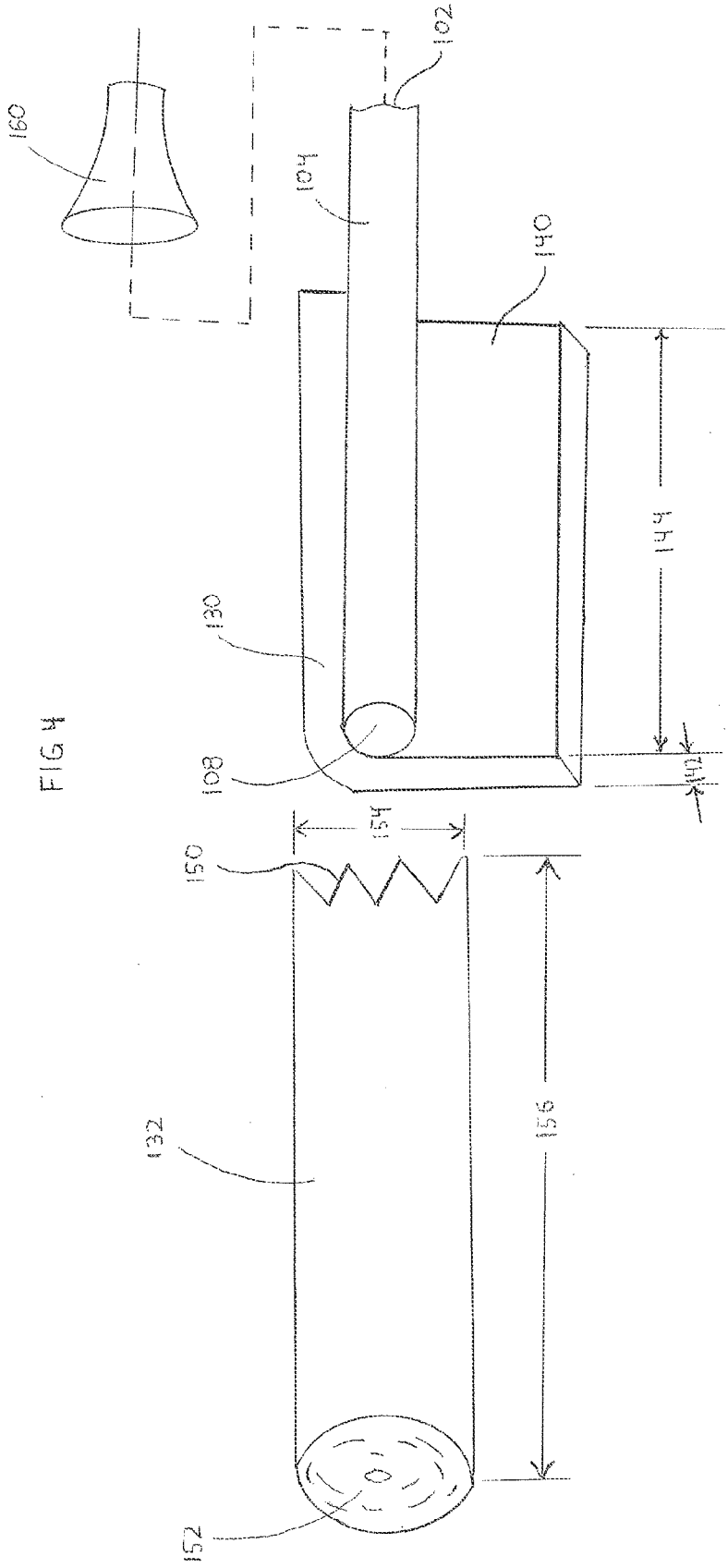
FIG. 4 is an assembly view illustrating one possible manner of assembling the improved popper to the shaft.

Referring to FIG. 4, to construct the popper 120, the resilient padded material 130 can be initially cut as a rectangular length of appropriate material 140 that is wrapped as a single layer around the circular shaft 102 adjacent to the distal end 108 and, in some embodiments, may possibly protrude beyond the distal end. The actual length dimension 144 of the layer of rectangular length of material 140 can be selected to be generally commensurate with the length of the popper 120 such as, for example, seven (7) or eight (8) inches. The selected thickness 142 of the layer of rectangular length of material 140 helps determine how far the popper 120 will protrude from the circumference of the shaft 102. The layer of rectangular length of material 140 can be secured around the distal end 108 of the shaft 102 by adhesive or tape. In other embodiments, however, the resilient padded member may be formed by other suitable methods such as making the resilient padded member from multiple layers continuously wound around the shaft, molding the resilient padded material directly onto the shaft or applying multiple cut pads of material radially about the circumference of the shaft.

Still referring to FIG. 4, the outer sleeve 132 can be formed as a tubular structure that has a first, opened end 150 and a second closed end 152. The opened end 150 of the outer sleeve 132 can be slid over the resilient padded material 130 secured to the shaft 102 until the closed end 152 is adjacently proximate to the distal end 108. Preferably, the diameter 154 of the outer sleeve 132 is such that the outer sleeve fits snugly or perhaps even tightly around the resilient padded member 130 and may provide a slight compressive effect. Moreover, the length 156 of the outer sleeve 132 should be sufficient to extend over and beyond the length of the resilient padded member 130. Referring to FIGS. 2 and 4, the opened end 150 of the outer sleeve 132 can be cinched around the circumference of the mid-length portion 104 of the shaft 102 with a rubber collar 160 or, in some embodiments, with elastic tape or tied thereto by string. In addition, adhesive may be used to help bond the outer sleeve 132 and the rubber collar 160 about the shaft 102. The cinching of the outer sleeve 132 promotes the bulbous, protruding shape of the thicker popper 120 with respect to the thinner mid-length portion 104 of the shaft 102. The outer sleeve 132 thereby encloses the resilient padded material 130 with the closed end 152 binding off the end of the popper 120 to help promote water impermeability.

Hence, in accordance with the foregoing disclosure, there is provided a riding crop having a pliable and bulbous shaped popper disposed at the distal end of the crop. The bulbous popper is thicker in diameter or cross-section with respect to the shaft so that the popper will typically contact the horse before any other portion of the riding crop. Therefore, the pliable popper is the primary portion of the riding crop that contacts the horse and can dissipate or absorb the striking force to avoid injuring or harming the horse.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An riding crop for controlling a horse comprising:

an elongated shaft having a proximal end, an opposite distal end, and a midlength portion extending generally between the proximal and distal ends, the shaft further including a handle located at the proximal end, the shaft further having a first cross-sectional dimension associated with the mid-length portion; and a bulbous, oblong popper disposed about the distal end of the shaft and extending about one quarter or less of the length of the riding crop from the midlength portion for contacting the horse, the popper having a second cross-sectional dimension that is larger than the first cross-sectional dimension to ensure the popper contacts the horse before any portion of the shaft, the popper further including a resilient padded member disposed at the distal end of the shaft and secured thereto by an outer sleeve disposed over the resilient padded member.

2. The riding crop of claim 1, wherein the resilient padded member is disposed around and surrounds the distal end of the shaft.

3. The riding crop of claim 2, wherein the resilient padded member is comprised of natural or synthetic foam rubber.

4. The riding crop of claim 3, wherein the outer sleeve is comprised of thin-walled, un-foamed elastic rubber and is generally tubular, the tubular outer sleeve including an open end for receiving the distal end of the shaft and the resilient padded member, the outer sleeve further including a closed end binding off the popper.

5. The riding crop of claim 4, wherein opened end of the outer sleeve has a natural diameter that is less than a pad diameter of the resilient pad member disposed around the distal end of the shaft such that the outer sleeve must stretch to be disposed over the resilient padded member.

6. The riding crop of claim 1, wherein the mid-length portion of the shaft and the popper are generally circular in cross-section such that the first cross-sectional dimension corresponds to a first diameter and the second cross-sectional dimension corresponds to a second diameter.

7. The riding crop of claim 6, wherein the first diameter is about ⅜ of an inch and the second diameter is about ⅞ of an inch.

8. The riding crop of claim 1, wherein the riding crop is about 30 inches in length from the proximal end to the distal end.

9. The riding crop of claim 8, wherein the popper is about 7+/−1 inches in length and the second diameter is generally continuous along the length of the popper.

* * * * *